United States Patent [19]

Toya et al.

[11] Patent Number: 4,855,547

[45] Date of Patent: Aug. 8, 1989

[54] VACUUM INTERRUPTER

[75] Inventors: Hideaki Toya; Tatsuya Hayashi, both of Amagasaki, Japan

[73] Assignee: Mitsubishi Denki Kabushiki Kaisha, Tokyo, Japan

[21] Appl. No.: 69,555

[22] PCT Filed: Nov. 12, 1986

[86] PCT No.: PCT/JP86/00576

§ 371 Date: Jun. 18, 1987

§ 102(e) Date: Jun. 18, 1987

[87] PCT Pub. No.: WO87/03136

PCT Pub. Date: May 21, 1987

[30] Foreign Application Priority Data

Nov. 12, 1985 [JP] Japan ..... 60-253961
Nov. 12, 1985 [JP] Japan ..... 60-253962
Aug. 21, 1986 [JP] Japan ..... 61-195966

[51] Int. Cl.[4] ..... H01H 33/66
[52] U.S. Cl. ..... 200/144 B
[58] Field of Search ..... 200/144 B

[56] References Cited

U.S. PATENT DOCUMENTS 3,327,081 6/1967 Pflanz ..... 200/144 B
4,196,327 4/1980 Kurosawa et al. ..... 200/144 B
4,473,731 9/1984 Yorita ..... 200/144 B

FOREIGN PATENT DOCUMENTS 0055008 6/1982 European Pat. Off. .
0104134 3/1984 European Pat. Off. .
0192251 8/1986 European Pat. Off. .
3401497 8/1984 Fed. Rep. of Germany .
3416368 12/1984 Fed. Rep. of Germany .

*Primary Examiner*—Robert S. Macon
*Attorney, Agent, or Firm*—Sughrue, Mion, Zinn, Macpeak and Seas

[57] ABSTRACT

A vaccum interrupter in which at least one of a pair of electrodes is provided with first high resistance areas formed passing through from a contact surface to a back side thereof at specified distances from a peripheral edge of the electrode and facing to each other and second high resistance areas extending from ends of the first high resistance areas toward a center of said electrode being not connected to each other, and in which outside parts of the electrode between the first high resistance areas and the peripheral edge is electrically connected to a conductive rod on the back side of the electrode by way of a bridge conductor arranged over the first high resistance areas.

19 Claims, 14 Drawing Sheets

VACUUM INTERRUPTER

FIELD OF THE INVENTION

The present invention relates to a vacuum interrupter of high mechanical strength in which an arc is stably and uniformly distributed on surfaces of electrodes, and electro-magnetic repulsive force generated at the time of applying a large current is reduced.

BACKGROUND OF THE INVENTION

Usually, as shown in FIG. 1, a vacuum interrupter comprises a vacuum container (1) closed with end plates (21), (22), a pair of electrodes (30), (40) facing to each other and conductive rods (5), (6) provided through said end plates (21), (22) and in which a bellows (7) is mounted on one electrode rode (6) to be movable in the axial direction without affecting air-tightness, and said electrodes (30), (40) are relatively movable and can be brought into contact with each other. Further, a shield (8) is provided to have deposited thereupon any evaporated metals. Said conductive rod (6) is driven by a drive mechanism not shown for switching operation of an electric circuit.

In such type of vacuum interrupter, it is well known that interruption performance can be improved by stably and uniformly distributing the arc on the surfaces of the electrodes by applying a magnetic field in parallel to the arc, particularly when interrupting a large current arc. It is also known that when said electrodes (30), (40) are in a closed state, an electro-magnetic repulsive force is generated due to the large current application, and a small gap is formed between said electrodes (30), (40), thereby generating a local arc which brings about welding or deteriorates the electrode surfaces, finally lowering withstand voltage performance.

To meet the aforesaid interruption of large current arc and to reduce the electro-magnetic repulsive force when applying a large current, a further vacuum interrupter has been proposed as shown in FIG. 2(*a*)-(*c*) (Japanese laid-open Patent Publication (unexamined) No. 57-3327). FIG. 2 (*a*) is a side view showing an example of arrangement of electrodes in such a prior vacuum interrupter, FIG. 2 (*b*) is a plan view in the direction of the arrow b—b in FIG. 2 (*c*), and FIG. 2 (*c*) is a plan view in the direction of the arrow c—c in FIG. 2 (*a*). In these drawings, reference numerals (50), (60) designate bridge conductors respectively fixed on the ends of the conductive rods (50), (60). These bridge conductors (5), (6) are rectangular and projecting parts (51), (52), (61), (62) are respectively formed on both ends thereof. Numerals (30), (40) designate a pair of electrodes connected electrically to each bridge conductor (50), (60) on their outer peripheral back sides respectively. As shown in FIG. 2 (*b*), (*c*), circular arc-shaped grooves (33), (34), (43), (44) serving as high resistance areas are formed on each electrode (30), (40) by cutting at required distances. Thus circular arc-shaped electrode parts (31), (32) and (41), (42) serving as outside parts of the electrodes partitioned by these grooves (33), (34) and (43), (44) are formed in the electrodes (30), (40). Said bridge conductor (50) is so arranged as to cross the grooves (43), (44), and the projecting parts (51), (52) and (61), (62) are electrically and mechanically connected to substantially middle parts of said circular arc-shaped electrode parts (31), (32) and (41), (42).

Gaps between said bridge conductors (50), (60) and the electrodes (30), (40) are desired to be as small as possible, but it is necessary that the gaps are in a range in which the electrodes (30), (40) do not come in contact with the bridge conductors (50), (60) when the electrodes are butted to each other which would bring about elastic deformation due to an applied mechanical force. The aforesaid electrode (30) and the bridge conductor (50) are respectively of the same configuration as the electrode (40) and the bridge conductor (60), but the electrode (40) and the bridge conductor (60) are so arranged as to face to the electrode (30) and the bridge conductor (50) being respectively turned by 90° therefrom.

According to this prior art, when an opening operation is performed by an operation mechanism not shown, an arc is formed between the electrodes (30), (40). In this step, when a current i flows from the conductive rod (5) toward the conductive rod (6), an arc is formed between a point A of the electrode (30) and a point A' of the electrode (40), the current i passes from the conductive rod (5) to the arc point A by way of the bridge conductor (50), the projecting part (51) thereof, the circular arc-shaped part (31) of said electrode (30) and through a gap B between the grooves (33), (34). That is, almost one turn is formed by a current loop (5)→(50)→(51)→(31)→B→A. Since the (51)→(31)→B→A is a loop formed by the electrode itself, the loop is near the point A of the arc and a strong axial magnetic field is generated. In the same manner, the current i passes from the point A' of the other electrode (40) to the conductive rod (6) by way of a gap C between the grooves (43), (44) of the electrode (40), the circular arc-shaped electrode part (41), the projecting part (61) and the bridge conductor (60). That is, one turn is further formed by a current loop A'→C→(41)→(61)→(60)→(6), and a magnetic field of the same axial direction as the foregoing loop is generated. Thus, a strong combined magnetic flux in the axial direction acts in parallel to the arc A—A' as indicated by the arrow Φ in FIG. 2(*a*), effectively preventing emission and diffusion of ionized metals from the arc to outside, acquiring a sufficient amount of plasma particles and stabilizing the arc. In the event that an accidental large current should flow in the closed state, an electro-magnetic repulsive force is generated at contact points due to concentration of the current and acts to separate the electrodes (30), (40), but since the current direction from the projecting part (51) to the gap B in the electrode (30) is same as that from the gap C to the projecting part (61) in the other electrode (40), the circular arc-shaped electrode parts (31), (41) are strongly attracted to each other. Actually, in the closed state of said electrodes (30), (40), a lot of contact points are distributed in the electrode surfaces and a quite strong electro-magnetic attractive force is generated on all areas of the circular arc-shaped electrode parts (31), (32) and (41), (42), and therefore the electro-magnetic repulsive force due to the current concentration at the contact points is effectively offset.

Thus, the electrode contact force applied to said electrodes (30), (40) can be greatly reduced by means of the operation mechanism not shown, and and the operation mechanism can be small-sized and light-weight.

According to the prior vacuum interrupter arranged as above, however, a serious problem exists in that, in the arc formed between the electrodes (30), (40), when the arc current is so large as to extend to the high resistance areas, i.e., the areas near the grooves (33), (34), (43), (44), the one turn cannot be formed by the current loop and the magnetic field necessary for the stable and uniform distribution of the arc is not generated, either. Moreover, another problem exists in that eddy current is generated inside the electrode section surrounded by the grooves (32), (34) or (43), (44) inhibiting thereby generation of an effective axial magnetic filed.

It is, therefore, an object of the present invention to overcome the above-discussed problems of the conventional vacuum interrupter and to provide a novel vacuum interrupter, in which one turn is formed by an electric current loop generated in the electrodes, and a strong axial magnetic field can be generated while interrupting eddy current passage.

SUMMARY OF THE INVENTION

In order to achieve the foregoing object, there is provided according to the present invention a vacuum interrupter, in which at least one of a pair of electrodes facing each other comprises first high resistance areas formed passing completely through a thickness of the one electrode from a contact surface to a back side thereof at specified distances from a peripheral edge of the electrode The one electrode further has second high resistance areas extending from ends of the first high resistance areas toward a center of said electrode but which are not connected to each other. In one electrode, outside parts of the electrode between the first high resistance areas and said peripheral edge are electrically connected to a conductive rod on said back side of the electrode by way of a bridge conductor arranged over the first high resistance areas so that one turn is formed by a current loop flowing through the electrode when an arc is formed anywhere on the electrode, preventing generation of eddy current and generating a strong axial magnetic field thereby.

BRIEF DESCRIPTION OF THE DRAWINGS

In the drawings forming a part of the present application.

BEST MODES OF CARRYING OUT THE INVENTION

Figure 3A:
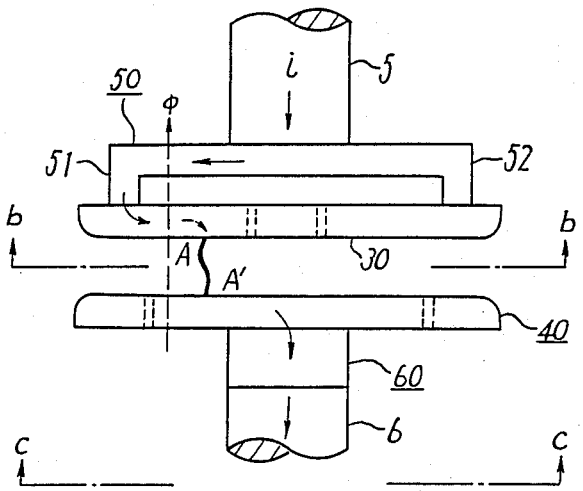
FIG. 3 shows an electrode structure in accordance with an embodiment of the present invention, and wherein (a) is a side view; and (b), (c) are plan views.
Figure 3B:
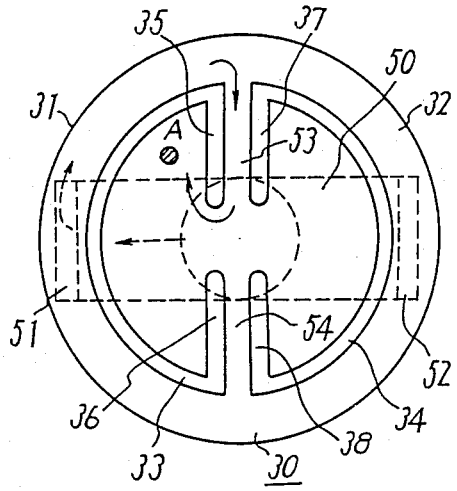
Figure 3C:
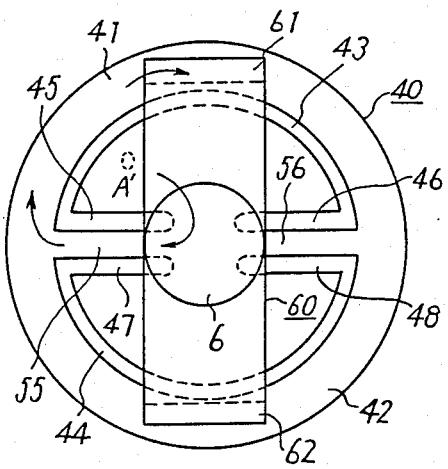

Referring now to the drawings, an embodiment of the present invention is described hereinafter. FIG. 3 (*a*) is a side view showing an electrode structure of a vacuum interrupter in accordance with an embodiment of the present invention, FIG. 3 (*b*) is a plan view in the direction of the arrow b—b in FIG. 3 (*a*), and FIG. 3 (*c*) is a plan view in the direction of the arrow c—c in FIG. 3 (*a*).

Figure 1:
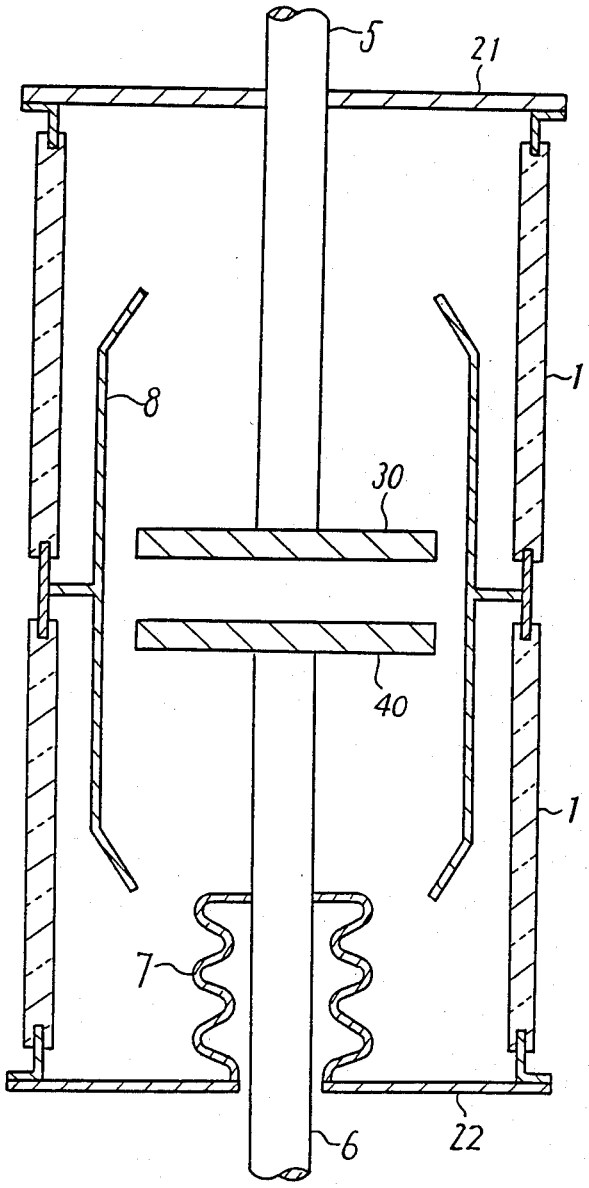
FIG. 1 is a sectional view showing a prior vacuum interrupter.
Figure 2A:
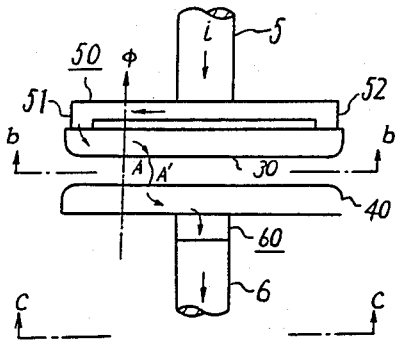
FIG. 2 shows an electrode structure of the prior vacuum interrupter, and wherein (a) is a side view; and (b), (c) are plan views.
Figure 2B:
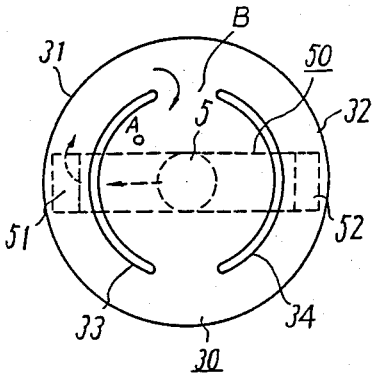
Figure 2C:
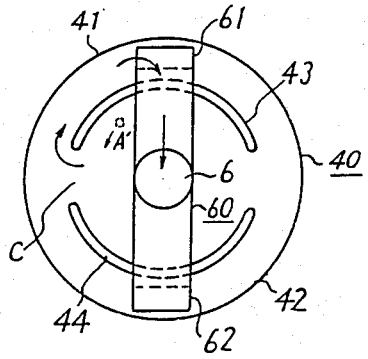

In the drawings, referenc numerals (33), (34), (43), (44) denote high resistance areas formed on each electrode (30), (40) passing through from the contact surface to the back side thereof at specified distances from peripheral edges of the electrode (30), (40). In this embodiment, the high resistance areas are arranged symmetrically with the center of each electrode therebetween forming a pair of grooves not connected to each other in the same manner as the prior art in FIG. 2(*a*-)-(*c*). Numerals (35)-(38), (45)-(48) denote second high resistance areas extending from both ends of the first high resistance areas (33), (34), (43), (44) toward the center of each electrode (30), (40). In this embodiment, the second high resistance areas are linear grooves formed substantially making a right angle to bridge conductors (50), (60). Each electrode (30), (40) is partitioned by the first and second high resistance areas (33)~(38), (45)~(48), thereby current passages (53), (54), (55), (56) linking outside parts (31), (32), (41), (42) of the electrodes (30), (40) and center parts thereof are formed. In this embodiment, the width of each current passage (53)~(56) is narrower than that of the bridge conductors (50), (60). The bridge conductors (50), (60) are arranged over the first high resistance areas (33), (34), (41), (42) to electrically and mechanically connect the outside parts (31), (32), (41), (42) to conductive rods (5), (6). The electrode (30) and the bridge conductor (50) are of the same configuration as the electrode (40) and the bridge conductor (50) respectively in this embodiment, but the electrode (40) and the bridge conductor (60) are so arranged as to face to the electrode (30) and the bridge conductor (50) respectively being deviated by 90° therefrom.

According to the vacuum interrupter in the embodiment described above, when opening operation is performed by an operation mechanism not shown, an arc is formed between the electrodes (30), (40). In this step, when a current i from the conductive rod (5) toward the conductive rod (6) and the arc is formed between a point A of one electrode (30) and a point A' of the other electrode (40), the current i passes from the conductive rod (5) to the arc point A by way of the bridge conductor (50), the projecting part (51), the outside part (31) and the current passage (53). That is, turn is formed by a current loop (50)→(51)→(31)→(53) A, and wherein since the (51)→(31)→(53)→A is a loop formed by the electrode itself and situated near the arc point A, a strong axial magnetic field is generated. In the same manner, the current i passes from the other point A' of the electrode (40) to the conductive rod (6) by way of the current passage (55), the outside part (41), the projecting part (61) and the bridge conductor (60). That is, one complete turn is further formed by the current loop A'→(55)→(41)→(61)→(60)→(6) and the same axial magnetic field as the foregoing current loop is formed. Thus, a strong combined axial magnetic flux acts in parallel to the arc A—A' indicated by the arrow Φ in FIG. 3 (*a*), emission and diffusion of ionized metals to the outside are effectively prevented and the arc is stabilized by acquiring a sufficient amount of plasma particles. In this connection, there is the possibility that an eddy current is generated in the electrodes (30), (40) due to magnetic flux Φ generating a magnetic field in the reverse direction and reducing the effective axial magnetic field thereby, but in accordance with the present invention, since the passage of such eddy current is completely intercepted by the second high resistance areas (35) (38), (45) (48), the generation of the magnetic field in the reverse direction can be prevented without taking any particular measure to cope with the eddy current.

Figure 4A:
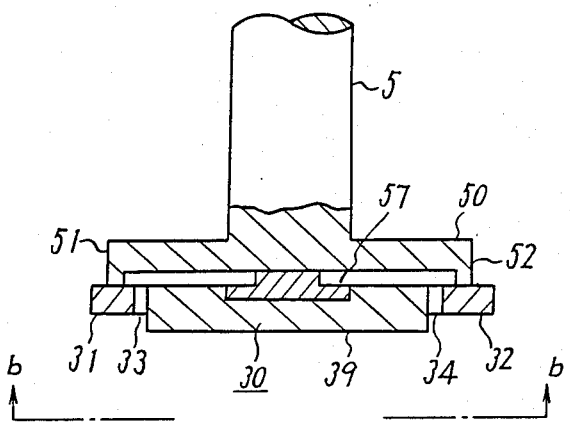
FIG. 4 shows another embodiment of the present invention, and wherein (a) is a sectional view; and (b) is a plan view.
Figure 4B:
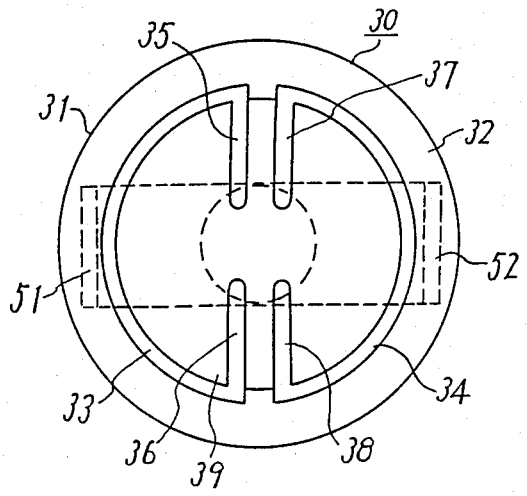

FIG. 4 (*a*), (*b*) shows another embodiment of the present invention, wherein a thin electrode structure is attained by interposing a reinforcing member (57) between the bridge conductor (50) and the electrode (30) considering that electrode materials of high conductivity such as copper, silver used in general have disadvantages in view of their low mechanical strength and high cost. An inside part (39) of the electrode (30) is slightly projected to prevent application of mechanical force to the outside parts (31), (32) of the electrode and arm parts of the bridge conductor (50) when performing opening and closing. A material such as stainless steel of lower conductivity than the electrode material is preferably used as the reinforcing member (57). It is also satisfactory to form the inside part (39) of the electrode (30) of an electrode material resistant to welding and high pressure, while forming the outside parts (31), (32) of common copper.

Although the inside part of the electrode is projected and further the reinforcing member is added in the foregoing embodiment, either one of such arrangements is satisfactorily employed.

Although only one electrode (30) and one bridge conductor (50) are shown in FIG. 4(*a*), (*b*), it is further satisfactory to have a structure in which both or either one of the facing electrodes and the bridge conductors is arranged as shown in FIG. 4 (*a*), (*b*).

Figure 5:
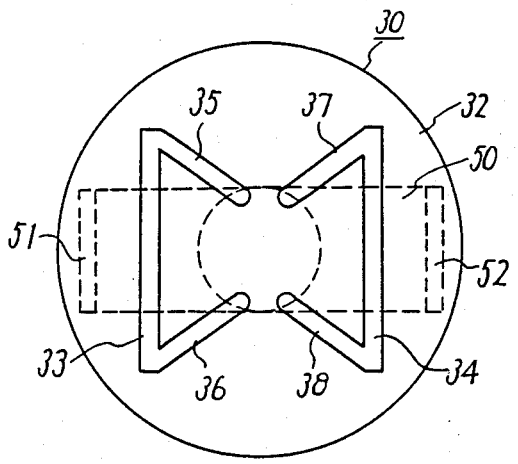
FIGS. 5 and 6 are plan view respectively showing further embodiments of the present invention.
Figure 6:
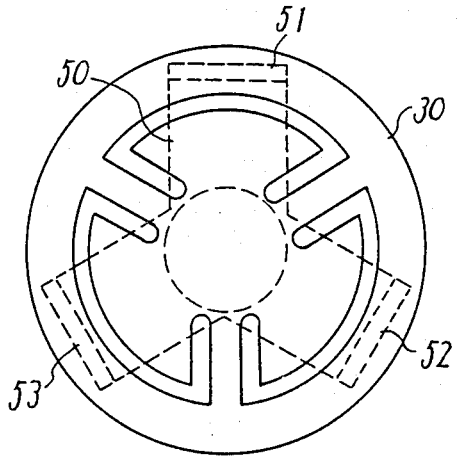

Although the arrangement in accordance with the present invention is applied to both of a pair of electrodes disposed in the vacuum container (1) in the foregoing embodiment, it is also satisfactory to apply such arrangement to either one electrode. The axial magnetic field can be generated without fail even when the first high resistance areas (33), (34) are formed linearly as is done in the embodiment of FIG. 5 instead of being circular arc-shaped. It is further preferable that, as shown in FIG. 6, the bridge conductor (50) is divided into three parts and the first high resistance areas are arranged to cross them, thereby increasing the area of generating the axial magnetic field. In this case, the electrodes facing each other are desired to be turned by 60° from each other. It is further preferable that the bridge conductor is divided into more than three parts and the first high resistance areas are arranged to cross them. The high resistance areas in the embodiments described above can be formed by filling the grooves (33)–(38), (43)–(48) with a high resistance material.

Figure 7A:
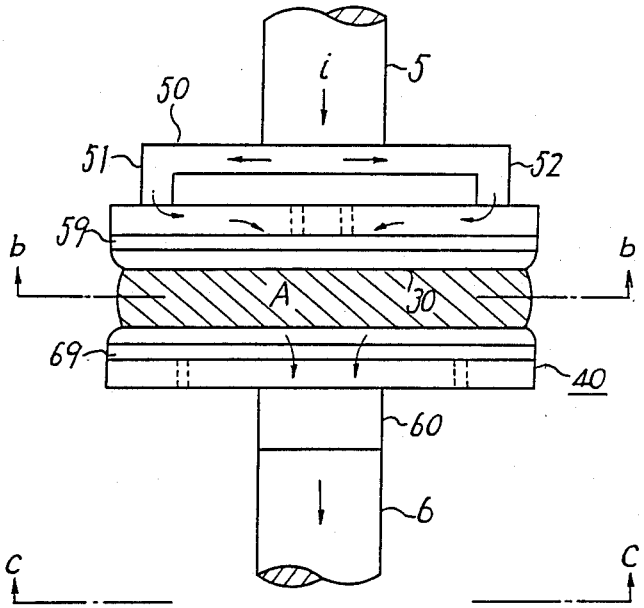
FIG. 7 shows an electrode structure of a vacuum interrupter in accordance with a further embodiment of the present invention, and wherein (a) is a side view; and (b), (c) are plan views.
Figure 7B:
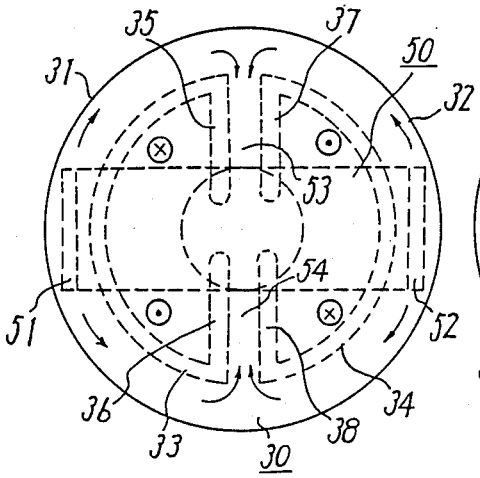
Figure 7C:
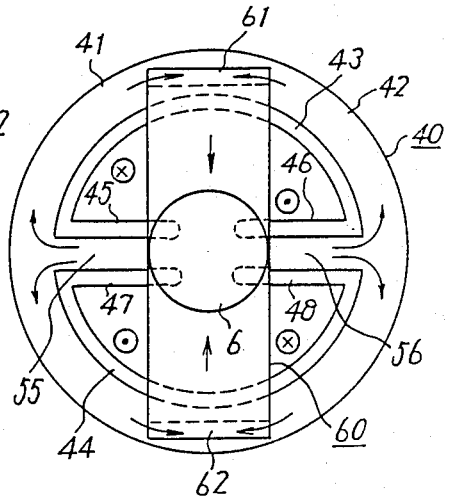

Referring now to FIG. 7, a still further embodiment is described hereunder. FIG. 7 (*a*) is a side view showing an electrode structure of a vacuum interrupter in accordance with the embodiment of the present invention, FIG. 7 (*b*) is a plan view in the direction of the arrow b—b FIG. 7(i a), and FIG. 7 (*c*) is a plan view in the direction of the arrow c—c in FIG. 7 (*a*). In these drawings, reference numerals (33), (34), (43), (44) denote grooves as the first high resistance areas in the same manner as the preceding embodiment in FIG. 3 (*a*) to (*c*), but in this embodiment the grooves do not pass through to the contact surfaces of the electrodes (30), (40). Instead the grooves have a certain depth from the back sides of the electrodes (30), (40) toward the contact surfaces and are formed at certain distances from the peripheral edges of the electrodes (30), (40). In the same manner, reference numerals (35)~(38), (45)~(48) denote the second high resistance areas, but they do not pass through from the contact surfaces of the electrodes (30), (40) to the back sides. Instead, these grooves have a certain depth from the back sides of the electrodes (30), (40) toward the contact surfaces. Numerals (59), (69) denote annular third high resistance areas formed inside the electrodes extending from the first high resistance areas (33), (34), (43), (44) toward the peripheral edges of the electrode and they are grooves in this embodiment.

According to the vacuum interrupter of this embodiment described above, when an opening operation is performed by an operation mechanism not shown, an arc A is formed between the electrodes (30), (40). This arc A is formed on all surfaces of the electrodes (30), (40) when the arc current is very large. In this step, the current i flowing from the conductive rod (5) toward the conductive rod (6), first passes through said conductive rod (5) and is divided into currents flowing in two directions opposite to each other as shown in FIG. 7 (*a*), then passes through the circular arc-shaped electrode parts (31), (32) flowing in two directions opposite to each other by way of the projecting parts (52), (53) as shown in FIG. 7 (*b*), and after passing through the current passages (53) and (54) between the second high resistance areas (35), (37) and (36), (38), reaches the arc area A by way of the contact surface of the electrode (30). That is, four single turns are formed by four current loops (50)→(51)→(31)→(53)→A, (50)→(51)→(31)→(54)→A, (50)→(52)→(32)→(53)→A and (50)→(52)→(32)→(54)→A. Since the loops (51)→A and (52)→A are formed in the electrode itself, these loops are near the arc and a strong axial magnetic field is generated.

In the same manner, as shown in FIG. 7 (*c*), in the other electrode (40), the current i coming from the contact surfaces passes through the current passages (55) and (56) after being divided into two anti-parallel currents, then flows through the circular arc-shaped electrode parts (41), (42) in two directions opposite to each other, and after passing through the projecting parts (61) and (62), reaches the conductive rod (6) by way of the bridge conductor (60). That is, four single turns are further formed by four current loops A→(55)→(41)→(61)→(60)→(6), A→(55)→(41)→(62)→(60)→(6), A→(56)→(42)→(61)→(60)→(6) and A→(56)→(42)→(62)→(60)→(6), and the axial magnetic field in the same direction as the preceding loops are further generated thereby. Furthermore, the axial magnetic fields generated by two of the loops are in reverse directions from the other two as shown in FIG. 7 (*b*), (*c*) and the magnetic fields in the center part of the elctrode axis are mutually offset. As a result, a residual magnetic flux affecting the extinction of ionized metals in the arc can be reduced. Accordingly, when a large current arc is formed, a strong axial magnetic field acts on almost all over the contact surfaces of the electrodes in parallel to the arc, thereby the arc is stably and uniformly distributed. Moreover, since the high resistance areas (33)~(38), (43)~(48), (59), (69) are not exposed on the contact surfaces and do not come in contact with the arc, local melting due to arc energy concentration can be effectively prevented.

Figure 8A:
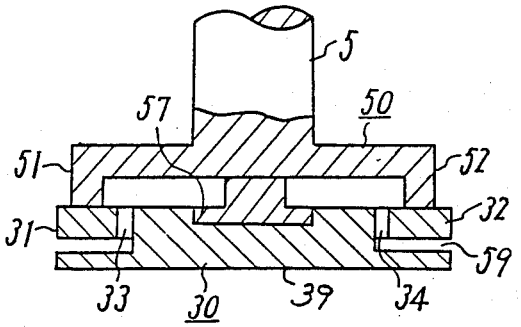
FIG. 8 shows a further embodiment of the invention, and wherein (a) is a sectional view; and (b) is a plan view.
Figure 8B:
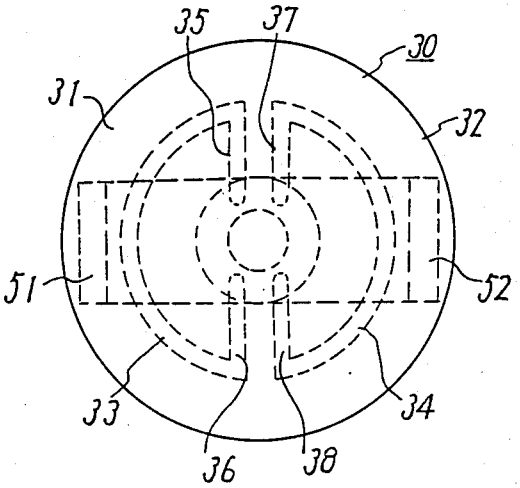

A yet further embodiment of the present invention is shown in FIG. 8 (*a*), (*b*), wherein a thin electrode structure is attained by interposing a reinforcing member (57) between the bridge conductor (50) and the electrode (30) considering that electrode materials of high conductivity such as copper or silver used in general have disadvantages in view of mechanical strength and cost saving. An inside part (39) of the electrode (30) is slightly projected to prevent application of mechanical force to the outside parts (31), (32) of the electrode and arm parts of the bridge conductor (50) when performing opening and closing. A material such as stainless steel of lower conductivity than the electrode material is preferably used as the reinforcing member (57). It is also satisfactory that the inside part (39) of the electrode (30) is formed of an electrode material resistant to welding and high pressure, while forming the outside parts (31), (32) of ordinary copper. Although only one electrode (30) and one bridge conductor (50) are shown in FIG. 8 (*a*), (*b*), it is further satisfactory to have a structure in which both or either one of the facing electrodes and the bridge conductors is arranged as shown in FIG. 4 (*a*), (*b*).

Although the arrangement in accordance with the present invention is applied to a pair of electrodes disposed in the vacuum container (1) in the foregoing embodiment, it is also satisfactory to apply such arrangement to either one of the electrodes.

Figure 9:
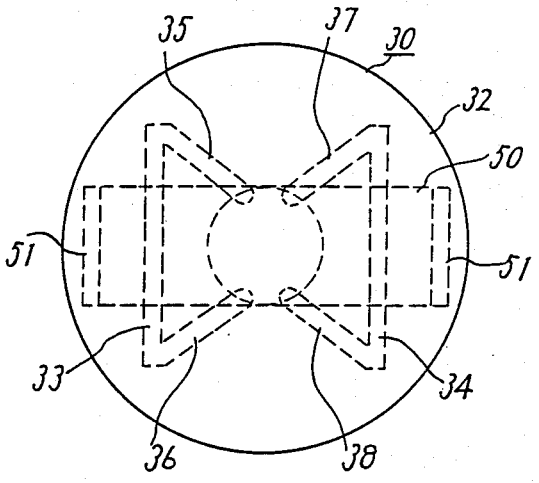
FIGS. 9 and 10 are plan views respectively showing further embodiments of the present invention.

The axial magnetic field can be generated even when the first high resistance areas (33), (34) are formed linearly as is done in the embodiment of FIG. 9 instead of being circular arc-shaped.

Figure 10:
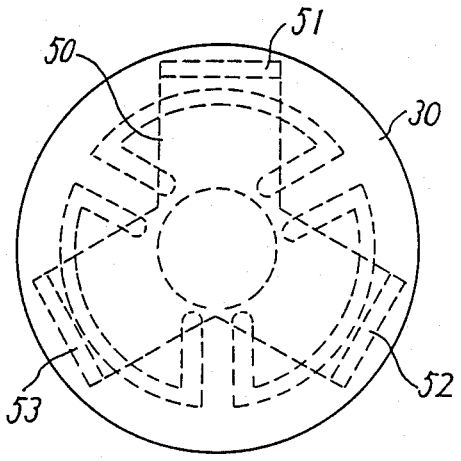
Figure 11A:
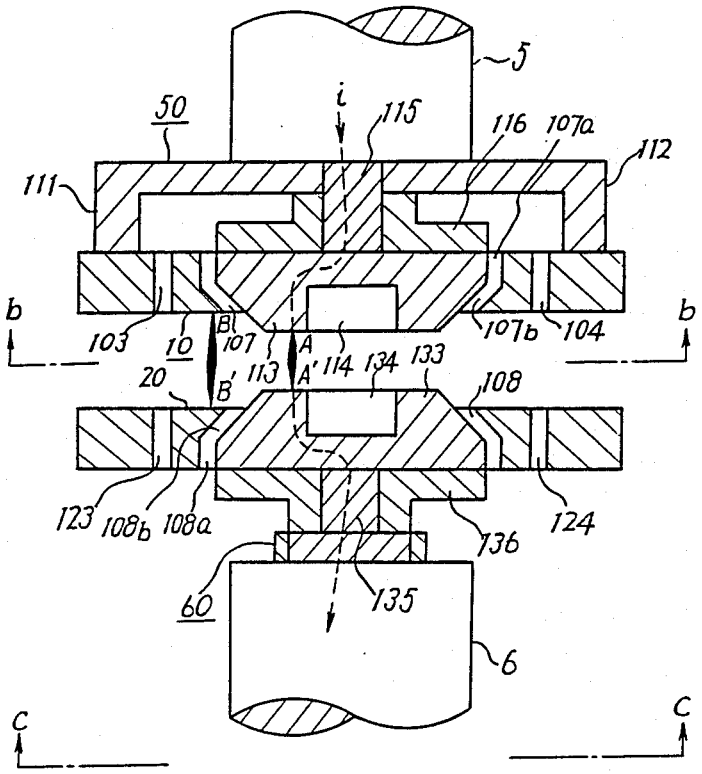
FIG. 11 shows an electrode structure of in accordance with a further embodiment of the invention, and wherein (a), (d) are sectional views; and (b), (c) are plan views.
Figure 11B:
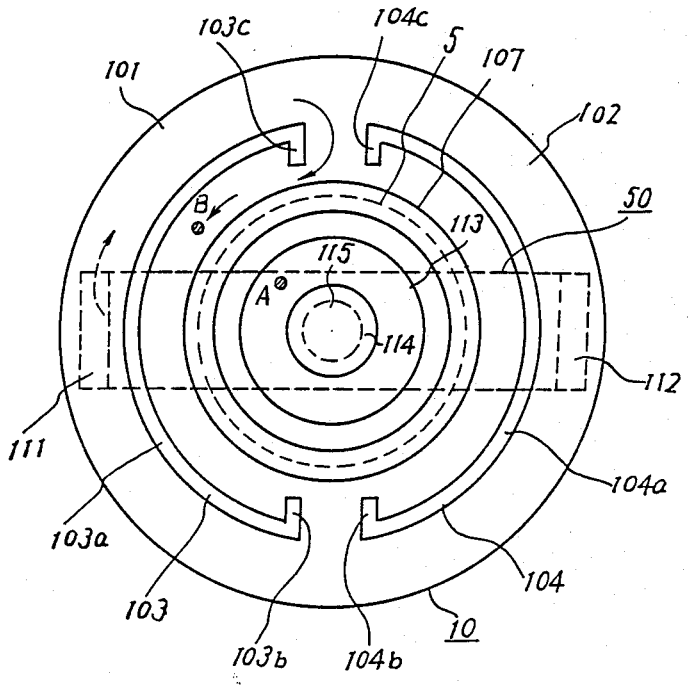
Figure 11C:
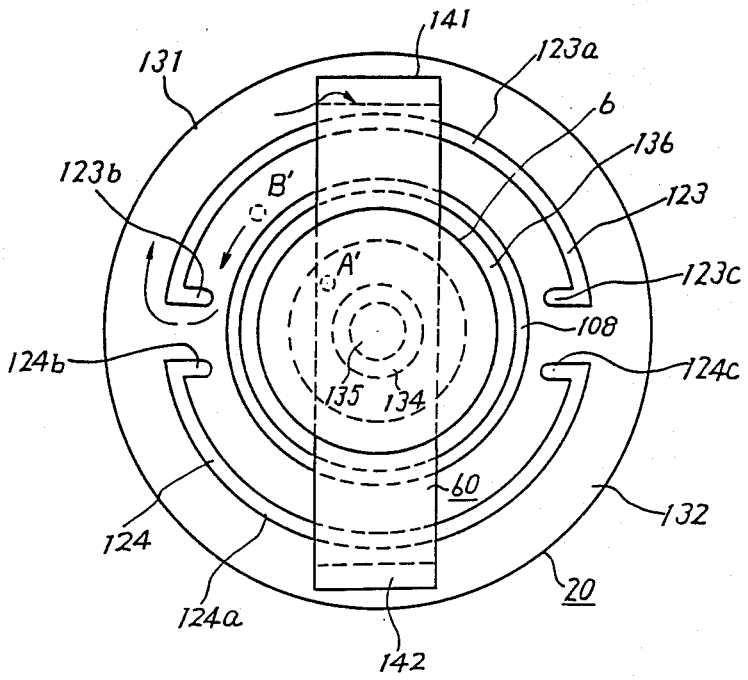
Figure 11D:
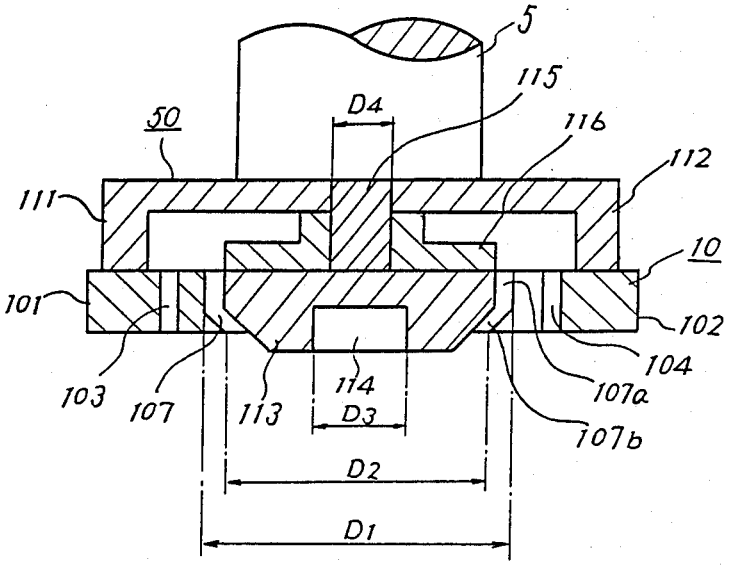

It is further preferable that, as shown in FIG. 10, the bridge conductor (50) is divided into three parts and the first high resistance areas are arranged to cross them, thereby increasing the area of generating the axial magnetic field. In this case, the electrodes facing each other are desired to be turned by 60° from each other. It is further preferable that the bridge conductor is divided into more than three parts and the first high resistance areas are arranged to cross them. The high resistance areas in the embodiments described above can be formed by filling the grooves (33)-(38), (43)-(48) with high resistance material.

Referring now to FIG. 11, (i a), (*b*) and (*c*), a still further embodiment is described hereunder. FIG. 11 (*a*) is a sectional view showing an electrode structure of a vacuum interrupter in accordance with the embodiment of the present invention, FIG. 11 (*b*) is a plan view in the direction of the arrow b—b in FIG. 11 (*a*), FIG. 11 (*c*) is a plan view in the direction of the arrow c—c in FIG. 11 (*a*) and FIG. 11 (*d*) is an explanatory sectional view showing one electrode in FIG. 11 (*a*). In these drawings, reference numerals (103), (104), (123), (124) denote the first high resistance areas formed on electrodes (10), (20) facing one another, passing through the electrodes (10), (20) from the facing surfaces to back sides and keeping certain distances from the peripheral edges of the electrodes (10), (20), e.g., at about 20% of the diameter. In this embodiment, the first high resistance areas are formed of grooves consisting of a pair of circular arc-shaped parts (103*a*), (104*a*), (123*a*), (124*a*) arranged substantially symmetrical with the center of each electrode therebetween and being not connected to one another, and linear parts (103*b*), (103*c*), (104*b*), (104*b*) (123*b*), (123*c*), (124*b*) (124*c*) extending from both ends of the circular arc toward the center of each electrode substantially making a right angle to the bridge conductors (50), (60) and being not connected to one another except through the arc-shaped parts. Numerals (107), (108) denote the second high resistance areas provided inside the first high resistance areas (103), (104), (123), (124), and, as shown in FIG. 11 (*d*), these second high resistance areas pass through the electrodes (10), (20) in a partially angular direction while connecting an annular high resistance area of which the outer diameter is $D_1$ on the electrode back sides to an annular resistance area of which the outer diameter is $D_2$ where there is a relation of $D_1 > D_2$ on the electrode facing sides. In the second high resistance areas of this embodiment, parallel annular parts (107*a*), (108*a*) are formed on the elctrodes back sides, while inclined annular parts (107*b*), (108*b*) are formed on the electrode facing sides toward the center of the electrode in continuation from the parallel annular parts (107*a*), (108*a*). The second high resistance areas are actually formed of annular hollow grooves coaxial with the first high resistance areas (103), (104), (123), (124). Numerals (113), (133) denote contactors each projecting annularly in a form of a ring of the inner diameter of which is $D_3$, i.e., recesses (114), (134) with diameter $D_3$ are formed on the center. The conductive rods (5), (6) are connected to back sides of the contactors (113), (134) by way of cylindrical conductive members (115), (135) with their outer diameter $D_4$ for electical connection to the outside of the vacuum container. Since there is a relation of $D_3 > D_4$ between this outer diameter $D_4$ of the conductive members (115), (135) and the inner diameter $D_3$ of the contactors (113), (133), the contactors (113), (133) come in contact with each other at the portion outside the diameter $D_4$. Usually, these contactors (113), (133) are made of an alloy of low melting point material such as bismuth and copper of which the mechanical strength is not high. Therefor in order to prevent the electrodes (10), (20) from deformation and breakage when they are opened and closed, reinforcing members (116), (136) of low conductivity and high mechanical strength such as stainless steel as compared with copper material, etc. are fixed to the back sides of the contactors (113), (133). Since the electrodes (10), (20) are disposed on the outer peripheries of the contactors (113),(133), the electrodes (10), (20) are insulated from the contactors (113), (133) with high insulation material as compared with the spacing portion or copper material forming the periphery of the second high resistance areas (107), (108). Each electrode (10), (20) are partitioned by the first high resistance areas (103), (104), (123), (124) respectively. The bridge conductors (50), (60) are respectively arranged on the back sides of the electrodes over the first high resistance areas (103), (104), (123) (124) so that the electrode outside parts (10), (20) and (131), (132) are electrically and mechanically connected to the conductive rods (5), (6). In this embodiment, the electrodes (10), (20) are formed of an alloy of copper and chromium.

The electrode (30) and the bridge conductor (50) are of the same configuration as the electrode (40) and the bridge conductor (60) respectively in this embodiment, but the electrode (40) and the bridge conductor (60) are so arranged as to face to the electrode (30) and the bridge conductor (50) being respectively turned by 90° therefrom. This is because a magnetic field formed by the current flowing through one electrode is in the same direction as a magnetic field formed by the current flowing through the other electrode.

The vacuum interrupter arranged as above described performs the following operation.

Since only the contactors (113), (133) are in state when turned on, the current passage is formed by the conductive rod (5), the conductive member (115), the contactors (113). (133), the conductive member (135) and the conductive rod (6) in order. An this time, the outer diameter $D_4$ of the conductive members (115), (135) and the inner diameter $D_3$ of the contactors (113), (133) are in the relation of $D_3 \geqq D_4$, so that the current does not flow linearly but is curved between the conductive members (115), (135) and the contactors (113), (133). Thereby an arc formed after opening the electrodes is easily transferred. Further, as compared with the prior art, since the current does not flow through the electrodes (10), (20) and the bridge conductors (50), (60) during the current application, generation of Joule heat is reduced. Heat generated on the contact surfaces of the contactors (113), (133) is promptly discharged outside the vacuum container by way of the conductive members (115), (135).

When performing opening operation, the current flows as indicated by the broken line in FIG. 11 (*a*) and an arc is formed between a point A of the contactor (113) and a point A' of the contactor (133). Since a force extruding the arc from the surfaces of the contactors (113), (133) outward is applied to the arc, the arc is transferred across the second high resistance areas (107) to discharge between points B, B' on the surfaces of the electrodes (10), (20). At this time, since there the outer diameter $D_1$ of the back side of the electrode differs from the outer diameter $D_2$ of the facing side, i.e., $D_1 > D_2$ in the second high resistance areas (107), (108), and in addition to the current outwardly curved at the contactors (113), (133), the inclined annular parts (107*b*), (108*b*) are formed on the facing sides, and the arc is easily transferred from between the points A—A' to between the points B—B'. When the arc discharges between the points B—B' of the electrodes (10), (20), the current i passes from the cunductive rod (5) to the point B by way of the bridge conductor (50), projecting part (111), outside part (10) of the electrode and through the conductive material between the linear parts (103*c*), (104*c*) of the first high resistance areas. The current i further passes from the point B' to the bridge conductor (60) through the conductive material between the linear parts (123*b*), (124*b*) of the first high resistance areas and by way of the outside part (131) of the electrode and projecting part (141).

That is, each single turn is formed by the current loop (50)→(111)→(101)→B and B'→(131)→(141)→(60), and an axial magnetic field is generated. As a result, an arc is stably and uniformly distributed on the surfaces of the electrodes, enabling interruption of large current thereby.

Figure 12A:
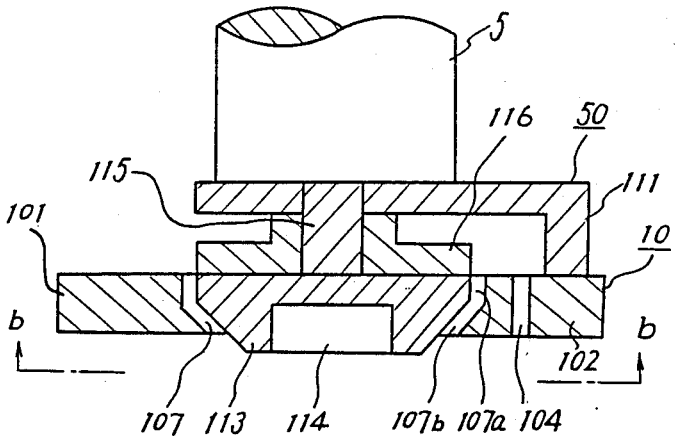
FIG. 12 shows a further embodiment of the present invention, and wherein (a) is a sectional view; and (b) is a plan view.
Figure 12B:
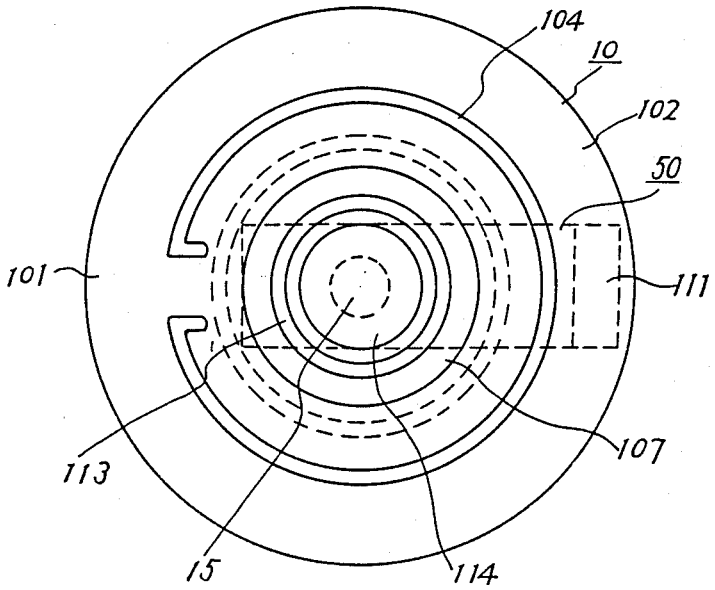

FIG. 12 (*a*), (*b*) are a sectional view and a plan view in the direction of the arrow b—b of a portion near one electrode of a vacuum interrupter in accordance with a yet further embodiment of the present invention. In this embodiment, each first high resistance area is formed into one circular arc and the bridge conductor (50) is transformed according to such configuration of the first high resistance area. The current applied does not flow through the electrode (10) and the bridge conductor (50) and Joule heat is not generated, either, in this embodiment. Accordingly the electrode (10) can be connected to the bridge conductor (50) at only one point in the projecting part (111). As a result, the current flowing through the outside part of the first high resistance area (104) is increased more than in the foregoing embodiments, and it is possible to generate a stronger axial magnetic field resulting in improvement of the interruption performance.

Although only one electrode (30) and one bridge conductor (50) are shown in FIG. 12 (*a*), (*b*), it is further satisfactory to have a structure in which both or either of the facing electrodes and the bridge conductors is arranged as shown in FIG. 12 (*a*), (*b*).

Figure 13:
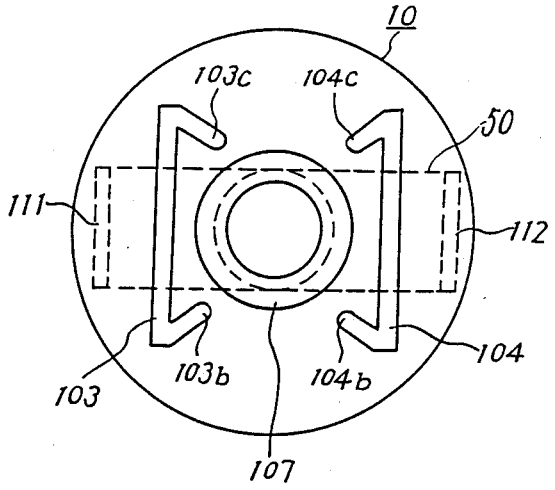
FIGS. 13 and 14 are plan views respectively showing further embodiments of the present invention.

Although the arrangement in accordance with the present invention is applied to a pair of electrodes disposed in the vacuum container (1) in the foregoing embodiment, it is also satisfactory to apply such arrangement to either one of the electrodes. The axial magnetic field can be generated even when the first high resistance areas (33), (34) are formed linearly as is illustrated in FIG. 13, similarly to that done in the embodiment of FIG. 10 instead of being circular arc-shaped.

Figure 14:
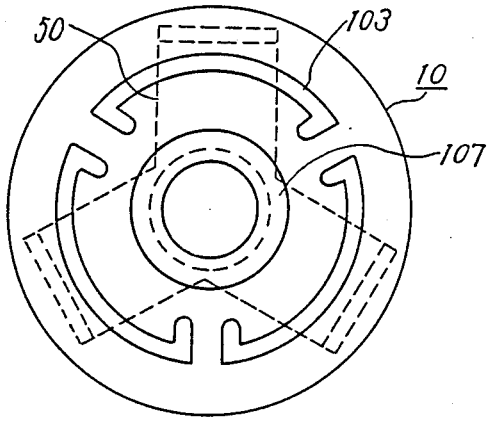

It is further preferable that, as shown in FIG. 14, the bridge conductor (50) is divided into three parts and the first high resistance areas are arranged to cross them, thereby increasing the area of generating the axial magnetic field. In this case, the electrodes facing each other are desired to be turned by 60° from each other considering the direction of the magnetic field. It is further preferable that the bridge conductor is divided into more than three parts and the first high resistance areas are arranged to cross them. The high resistance areas in the embodiments described above can be formed by filling the groove (33)~(38), (43)~(48) with a high resistance material. In addition, it is satisfactory that the first high resistance areas have no linear part substantially making a right angle to the bridge conductors and directed toward the center of each electrode.

POSSIBILITY OF INDUSTRIAL UTILIZATION

The present invention can be utilized for vacuum interrupters.

We claim:

1. A vacuum interrupter for opening and closing a current passage by a pair of electrodes which are incorporated in a vacuum container, connectable and detachable to and from each other and respectively mounted on conductive rods, wherein at least one of said pair of electrodes comprises first high resistance areas formed passing through from a contact surface to a back side thereof at specified distances from a peripheral edge of the electrode and facing to each other, and second high resistance areas extending from ends of the first high resistance areas toward a center of said electrode being not connected to each other, and wherein outside parts of the electrode disposed between the first high resistance areas and said peripheral edges are electrically connected to said conductive rod on said back side of the electrode by way of a bridge conductor arranged over the first high resistance areas, wherein the first and second high resistance areas comprise three circular arc-shaped parts with substantially equal radii arranged around the center of the electrode at substantially equal distances thereamong but which are not connected to one another, and linear parts extending from ends of said circular arc-shaped parts toward the center of the electrode and not being connected to one another, and wherein the bridge conductor has three leg parts electrically connected respectively to the outside parts of the electrode over said circular arc-shaped first high resistance areas to be electrically connected to the conductive rod at a portion joining the leg parts to one another.

2. A vacuum interrupter for opening and closing a current passage by a pair of electrodes which are incorporated in a vacuum container, connectable and detachable to and from each other and respectively mounted on conductive rods, wherein at least one of said pair of electrodes comprises first high resistance areas formed passing through from a contact surface to a back side thereof at specified distances from a peripheral edge of the electrode and facing to each other, and second high resistance areas extending from ends of the first high resistance areas toward a center of said electrode but which are not connected to each other, and wherein outside parts of the electrode disposed between the first high resistance areas and said peripheral edges are electrically connected to said conductive rod on said back side of the electrode by way of a bridge conductor arranged over the first high resistance areas, wherein the first high resistance areas comprise a pair of straight first linear parts arranged substantially symmetrical with the center of the electrode therebetween, and the second high resistance areas comprise straight second linear parts extending from ends of said first linear parts toward the center of the electrode and not being connected to each other, and wherein the bridge conductor is arranged over said pairs of linear first high resistance areas and electrically connected to the conductive rod at a substantially central portion thereof.

3. A vacuum interrupter for opening and closing a current passage by a pair of electrodes which are incorporated in a vacuum container, connectable and detachable to and from each other and respectively mounted on conductive rods, wherein at least one of said pair of electrodes comprises first high resistance areas formed passing through from a contact surface to a back side thereof at specified distances from a peripheral edge of the electrode and facing to each other, and second high resistance areas toward a center of said electrode but which are not connected to each other, and wherein outside parts of the electrode disposed between the first high resistance areas and said peripheral edges are electrically connected to said conductive rod on said back side of the electrode by way of a bridge conductor arranged over the first high resistance areas, wherein the second high resistance areas are so arranged as to come nearer to each other than a minimum width of the bridge conductor.

4. A vacuum interrupter for opening and closing a current passage by a pair of electrodes which are incorporated in a vacuum container, connectable and detachable to and from each other and respectively mounted on conductive rods, wherein at least one of said pair of electrodes comprises first high resistance areas formed passing through from a contact surface to a back side thereof at specified distances from a peripheral edge of the electrode and facing to each other, and second high resistance areas extending from ends of the first high resistance areas toward a center of said electrode but which are not connected to each other, and wherein outside parts of the electrode disposed between the first high resistance areas and said peripheral edges are electrically connected to said conductive rod on said back side of the electrode by way of a bridge conductor arranged over the first high resistance areas, wherein a reinforcing material of lower conductivity than that of the electrode is inserted between the bridge conductor and the electrode, said reinforcing material having a lateral portion perpendicular to an axis of said rod, said lateral portion having a diameter substantially less than a separation distance of legs of said bridge conductor contacting said electrode and, further wherein said diameter of said lateral portion is smaller than the width of said bridge conductor.

5. A vacuum interrupter for opening and closing a current passage by a pair of electrodes which are incorporated in a vacuum container, connectable and detachable to and from each other and respectively mounted on conductive rods, wherein at least one of said pair of electrodes comprises first high resistance areas formed passing through from a back side to a middle region thereof at specified distances from a peripheral edge of the electrode and facing to each other, second high resistance areas extending from ends of the first high resistance areas toward a center of said electrode but which are not connected to each other and an annular third high resistance area formed extending from the first high resistance areas at said middle region inside the electrode to said peripheral edge of the electrode, a contact surface of said electrode extending radially outward in a direction along said third high resistance region and wherein outside parts of the electrode between the first high resistance areas and said peripheral edge are electrically connected to said conductive rod on said back side of the electrode by way of a bridge conductor arranged over the first high resistance areas.

6. The vacuum interrupter according to claim 5, wherein the first high resistance areas are circular arc-shaped high resistance areas arranged substantially symmetrical with the center of the electrode therebetween and not being connected to each other.

7. The vacuum interrupter according to claim 5 or 6, wherein the first, second and third high resistance areas are respectively formed of hollow grooves.

8. The vacuum interrupter according to claim 5, wherein a reinforcing member of lower conductivity than a material of the electrode is inserted between the bridge conductor and the electrode in an area of said back side extending no further radially outward than said third high resistance area at said back side.

9. The vacuum interrupter according to claim 5, wherein inside and outside parts of the electrode are respectively formed of different electrode materials.

10. The vacuum interrupter according to claim 5, wherein the pair of electrodes are formed into substantially the same configuration and are facing to each other with an angle therebetween so that a magnetic field formed by a current flowing through one electrode is in a same direction as a magnetic field flowing through the other electrode.

11. A vacuum interrupter for opening and closing a current passage by a pair of electrodes which are incorporated in a vacuum container, connectable and detachable to and from each other and respectively mounted on conductive rods, wherein at least one of said pair of electrodes comprises:

first high resistance areas formed passing through from a facing surface to a back side thereof at specified distances from a peripheral edge of the electrode and facing to each other;

a second high resistance area formed inside and separated from the first high resistance areas of said one electrode and passing through said electrode while connecting an annular high resistance area of which an outer diameter is $D_1$ on the back side of the electrode to an annular resistance area of which an outer diameter is $D_2$ in the facing surface of the one electrode, wherein $D_1 > D_2$;

a contactor projecting in a form of a ring toward the other of said electrodes from said facing surface and of which an inner diameter is $D_3$.

a cylindrical conductive member connecting said contactor to a respective one of said conductive rods and having an outer diameter $D_4$, wherein $D_3 \geqq D_4$, and a bridge conductor arranged over the first high resistance areas electrically connecting outside parts of the electrode between the first high resistance areas and said peripheral edge to said respective conductive rod on said back side of the electrode.

12. The vacuum interrupter according to claim 11, wherein the first high resistance areas comprise a pair of circular arc-shaped parts arranged substantially symmetrical with the center of the electrode therebetween and not being connected to each other, and straight linear parts extending from ends of said circular arc-shaped parts to the center of the electrode substantially making a right angle to the bridge conductor and not being connected to each other, and wherein the bridge conductor is electrically connected to the outside parts of the electrode by two opposed leg ends separated on the back side of the electrode by said first high resistance areas and is arranged over said first high resistance areas to be electrically connected to the conductive rod at a substantially middle portion thereof.

13. The vacuum interrupter according to claim 11, wherein the first high resistance areas comprise three circular arc-shaped parts with substantially equal radii arranged at substantially equal distances from a center of the electrode and not being connected to one another, and linear parts extending from ends of said circular arc-shaped parts toward the center of the electrode and not being connected to one another, and wherein the bridge conductor has three leg parts electrically connected respectively to the outside parts of the electrode over said circular arc-shaped first high resistance areas to be electrically connected to the conductive rod at a portion joining the leg parts to one another.

14. The vacuum interrupter according to claim 11, wherein the first high resistance areas comprise a pair of first straight linear parts arranged substantially symmetrical with the center of the electrode therebetween, and second straight linear parts extending from ends of said linear parts toward the middle of the electrode and not being connected to each other, and wherein the bridge conductor is arranged over said pairs of linear first high resistance areas and electrically connected to a respective one of the conductive rods at a substantially central portion thereof.

15. The vacuum interrupter according to claim 11, 18, 19 or 20, wherein the first and second high resistance areas are formed of hollow grooves.

16. The vacuum interrupter according to claim 11, wherein a reinforcing member of lower conductivity than a material of the electrode is inserted between the bridge conductor and the electrode.

17. The vacuum interrupter according to claim 11, wherein both of the pair of electrodes are formed into a substantially same configuration and are facing to each other with an angle therebetween so that a magnetic field formed by current flowing through one electrode is in a same direction as a magnetic field flowing through the other electrode.

18. The vacuum interrupter according to claim 11, wherein said contactor has an inclined surface defining a side of said second high resistance area and projecting toward the other of said electrodes from said facing surface.

19. A vacuum interrupter for opening and closing a current passage by a pair of electrodes which are incorporated in a vacuum container, connectable and detachable to and from each other and respectively mounted on conductive rods, wherein at least one of said pair of electrodes is provided with first high resistance areas formed passing through from a contact surface to a back side thereof at specified distances from a peripheral edge of the electrode and facing to each other, and second high resistance areas extending from ends of the first high resistance areas toward a center of said electrode being not connected to each other, and wherein outside parts of the electrode disposed between the first high resistance areas and said peripheral edges are electrically connected to said conductive rod on said back side of the electrode by way of a bridge conductor arranged over the first high resistance areas wherein a central portion of said bridge conductor is suspended over said one electrode with free space therebetween.

* * * * *